US011660625B2

(12) United States Patent
Knight

(10) Patent No.: US 11,660,625 B2
(45) Date of Patent: May 30, 2023

(54) ANTI-ROTATIONAL PLUG SEAL FOR LOCK-DOWN PUMP DISPENSER

(71) Applicant: RIEKE PACKAGING SYSTEMS LIMITED, Leicestershire (GB)

(72) Inventor: Simon Christopher Knight, Bridgend South Wales (GB)

(73) Assignee: RIEKE PACKAGING SYSTEMS LIMITED

( * ) Notice: Subject to any disclaimer, the term of this patent is extended or adjusted under 35 U.S.C. 154(b) by 58 days.

(21) Appl. No.: 17/598,330

(22) PCT Filed: Mar. 26, 2020

(86) PCT No.: PCT/EP2020/058609

§ 371 (c)(1),
(2) Date: Sep. 27, 2021

(87) PCT Pub. No.: WO2020/193723

PCT Pub. Date: Oct. 1, 2020

(65) Prior Publication Data

US 2022/0176396 A1 Jun. 9, 2022

Related U.S. Application Data

(60) Provisional application No. 62/823,837, filed on Mar. 26, 2019.

(51) Int. Cl.
*B05B 11/00* (2023.01)
*B05B 11/10* (2023.01)

(52) U.S. Cl.
CPC ..... *B05B 11/106* (2023.01); *B05B 11/1001* (2023.01); *B05B 11/1047* (2023.01)

(58) Field of Classification Search
CPC ..... B05B 11/306; B05B 11/0027; B05B 11/3001; B05B 11/106; B05B 11/1001;
(Continued)

(56) References Cited

U.S. PATENT DOCUMENTS 3,228,347 A * 1/1966 Corsette ..... B05B 11/3001 417/520
3,656,646 A 4/1972 Taylor
(Continued)

FOREIGN PATENT DOCUMENTS

EP 0105000 4/1984
EP 0606261 8/1992
(Continued)

OTHER PUBLICATIONS

Patent Cooperation Treaty (PCT), International Search Report and Written Opinion for Application PCT/EP2020/058609 filed Mar. 26, 2020, dated May 29, 2020, International Searching Authority, EP.

*Primary Examiner* — Vishal Pancholi
(74) *Attorney, Agent, or Firm* — McDonald Hopkins LLC

(57) ABSTRACT

A universal closure for a dispenser is contemplated. The closure seals to the container neck along three separate surfaces with sufficient force to enable the use of lockdown and/or anti-rotational features to secure the dispenser for e-commerce shipments. Provision of frictional projections secures a sufficiently tight fit between the container neck and the body insert of the closure so as to eliminate the need to force separate engagement features on the container itself.

20 Claims, 6 Drawing Sheets

(58) Field of Classification Search
CPC ..... B05B 11/1047; B05B 11/3007; B05B 11/3023; B05B 11/0044; B05B 11/3047; B05B 11/3074
See application file for complete search history.

(56) References Cited

U.S. PATENT DOCUMENTS

| | | | | |
|---|---|---|---|---|
| 3,924,782 | A | 12/1975 | Starrett | |
| 4,273,257 | A | 6/1981 | Smith | |
| 4,826,054 | A | 5/1989 | Frutin | |
| 7,168,598 | B2 | 1/2007 | Gueret | |
| 7,530,476 | B2 | 5/2009 | Downey | |
| 7,588,198 | B2 | 9/2009 | Hornsby | |
| 7,802,701 | B2 | 9/2010 | Jahan | |
| 8,827,121 | B2 | 9/2014 | Law | |
| 9,480,802 | B2 | 11/2016 | Barber | |
| 9,737,127 | B2 | 8/2017 | Moretti | |
| 9,776,772 | B2 | 10/2017 | Tada | |
| 11,413,638 | B2 | 8/2022 | Knight | |
| 2012/0024909 | A1* | 2/2012 | Carta | B05B 11/3007 222/321.9 |
| 2014/0371690 | A1 | 12/2014 | Sprada | |
| 2017/0128966 | A1* | 5/2017 | Law | B05B 11/306 |
| 2017/0128967 | A1 | 5/2017 | Law | |
| 2018/0304291 | A1 | 10/2018 | Knight | |

FOREIGN PATENT DOCUMENTS

| | | |
|---|---|---|
| WO | 2010113199 | 10/2010 |
| WO | 2017186541 | 11/2017 |
| WO | 2017198626 | 11/2017 |
| WO | 20180215659 | 11/2018 |

* cited by examiner

ANTI-ROTATIONAL PLUG SEAL FOR LOCK-DOWN PUMP DISPENSER

CROSS-REFERENCE TO RELATED APPLICATION

This application is a 35 U.S.C. 071 national stage application of PCT Application No. PCT/EP2020/058609 filed on Mar. 26, 2020, which claims priority to U.S. Provisional Patent Application Ser. No. 62/823,837 filed on Mar. 26, 2019 each of which is incorporated by reference in their entireties herein.

TECHNICAL FIELD

The present invention relates generally to lockable pump dispensers appropriate for e-commerce shipping and, more specifically, to a rotational plug seal adaptor for use in container necks that have not been modified in order to enable the use of a lockable pump.

BACKGROUND

Containers for everyday household fluid products, such as soaps, cleaners, oils, consumable liquids, and the like, can be outfitted with dispensing pumps to improve a consumer's ability to access and use the fluid. Dispensing pumps of this type usually rely upon a reciprocating pump, driven by a compressible biasing member.

These products reach the end-use consumer via a bulk-shipment retail supply chain or by way of e-commerce (i.e., delivery to the consumer's home or business). Both supply chains require safeguards against damage and/or leakage of fluid caused by dropping the container(s), vibration, and the like. However, the e-commerce channel is particularly demanding since it is more cost effective to ship individual containers without any additional packaging. Also, because e-commerce shipping does not involve pallets or other means of confining the container to an upright position, the rotation, inversion, and jostling/vibration of the container and dispensing pump increases the likelihood that fluid can leak from the container. Despite these issues, the need for containers with dispensing pumps that can withstand the rigors of shipment also is expected to grow because of the growing popularity of on-line retailers who sell and ship individual fluid-containing products via e-commerce.

In that context, the biasing action of reciprocal pumps is particularly difficult. Most pumps urge the dispensing head upward to create suction that draws up and expels the fluid out of the dispensing head. However, in the extended position, the dispensing head and pump stem are particularly fragile and prone to actuation if the head is depressed. Also, many pumps include air inlets to ensure smooth and efficient dispensing actions, and these inlets themselves present additional pathways for leakage during shipment. Consequently, dispensing pump containers are provided with locking mechanisms in an attempt to avoid leakage and loss of fluid.

One conventional pump mechanism, disclosed in United States Patent Publication 2018/0304291, describes a number of downlock mechanisms which might alleviate some of the concerns noted above. A cylindrical sealing surface is formed on a discrete end piece that is interposed between the pumping piston and the inlet valve/ball valve configuration. This seal engages a corresponding inward nib projection formed near the dip tube socket on the cylinder defining the pump chamber of the piston. In this manner, fluid from the container should not leak into the pump when it is locked down.

Another pump is disclosed in WO2018/215659. This mechanism relies upon a screw-lock in which threads formed on the dispenser head engage corresponding features on a body insert/collar. Ribs or fins are provided adjacent to the stem of the dispenser head so as to prevent unwanted rotation and disengagement of the lock-down threads.

In these designs, a distinction should be made between a screw-threaded locking mechanism and a separate rotational lock. The former is responsible for restraining the natural tendency of the biasing spring in the pump engine to extend or reciprocate. The latter is intended only as a complement to the locking mechanism, with the rotational lock merely presenting resistance and/or a further safeguard against disengagement of the locking mechanism (i.e., when screw-threads are used, sufficient twisting to separate the threads of the reciprocating element from the threads of the stationary element). As such, the rotational lock disengagements are only a fractional amount of rotation in comparison to the locking mechanism. But use of the terms "rotational" and "lock" are not mutually exclusive, and it will be understood that in certain embodiments both the rotational lock and the locking mechanism may require a similar twisting action to engage or disengage those features.

Separately, all of these pumps rely upon a threaded engagement between the closure of the pump and the container/bottle itself. Thus, in addition to distinguishing between the rotational distance and force required to differentiate the rotational lock from the locking mechanism, it is also necessary to acknowledge the screw-type engagement the pump itself relies upon to seal and remain attached to the container.

One solution to distinguish between the closure seal and the locking mechanism rotation (and the rotational lock itself, if used) was to impart a counterclockwise screw-thread to one and a clock-wise screw thread to the other. However, in practice, users found this arrangement to be cumbersome and unfamiliar. Further, manufacturing and filling equipment may not be readily adaptable enough to accommodate these different tightening directions.

Thus, another solution was to impart features (e.g., ratchet-style teeth) on the container neck itself. These features cooperate with cooperating features on the pump/closure, so as to ensure the pump cannot be removed from the container by the twisting force needed to engage or disengage the locking mechanism. Of course, the problem with this approach is that it requires unique modifications to the container neck itself, thereby limiting the type and style of containers on which the locking mechanism (and optional rotational locks) might be employed. Therefore, a lockdown design that is readily adaptable to unmodified containers would be welcome.

SUMMARY OF INVENTION

Operation of the invention may be better understood by reference to the detailed description, drawings, claims, and abstract—all of which form part of this written disclosure. While specific aspects and embodiments are contemplated, it will be understood that persons of skill in this field will be able to adapt and/or substitute certain teachings without departing from the underlying invention. Consequently, this disclosure should not be read as unduly limiting the invention(s).

In one aspect, the present proposals provide a reciprocating pump dispenser which includes a dispensing head with a threaded lockdown feature received within and secured to the closure body of the pump. Because the closure body is attached to the container, the dispenser head will not retract when locked down. An anti-rotational closure plug includes gripping mechanisms and the head has at least one fin or rib received within a ramped slot, so that this combination prevents accidental rotation that might otherwise cause the unwanted disengagement of the lockdown feature. As such, the pump is particularly well-suited for use in the e-commerce channel, as it provides an alternative arrangement in which the pump can be attached to container necks that may not have the structures disclosed/required by prior art designs.

Further aspects and preferred options are set out in the appended claims and in the description which follows.

DESCRIPTION OF THE DRAWINGS

The appended drawings form part of this specification, and any information on/in the drawings is both literally encompassed (i.e., the actual stated values) and relatively encompassed (e.g., ratios for respective dimensions of parts). In the same manner, the relative positioning and relationship of the components as shown in these drawings, as well as their function, shape, dimensions, and appearance, may all further inform certain aspects of the invention as if fully rewritten herein. Unless otherwise stated, all dimensions in the drawings are with reference to inches, and any printed information on/in the drawings form part of this written disclosure.

In the drawings and attachments, all of which are incorporated as part of this disclosure:

FIG. 7A shows an isolated perspective view of the body and the closure/skirt, while

DETAILED DESCRIPTION

Figure 1:
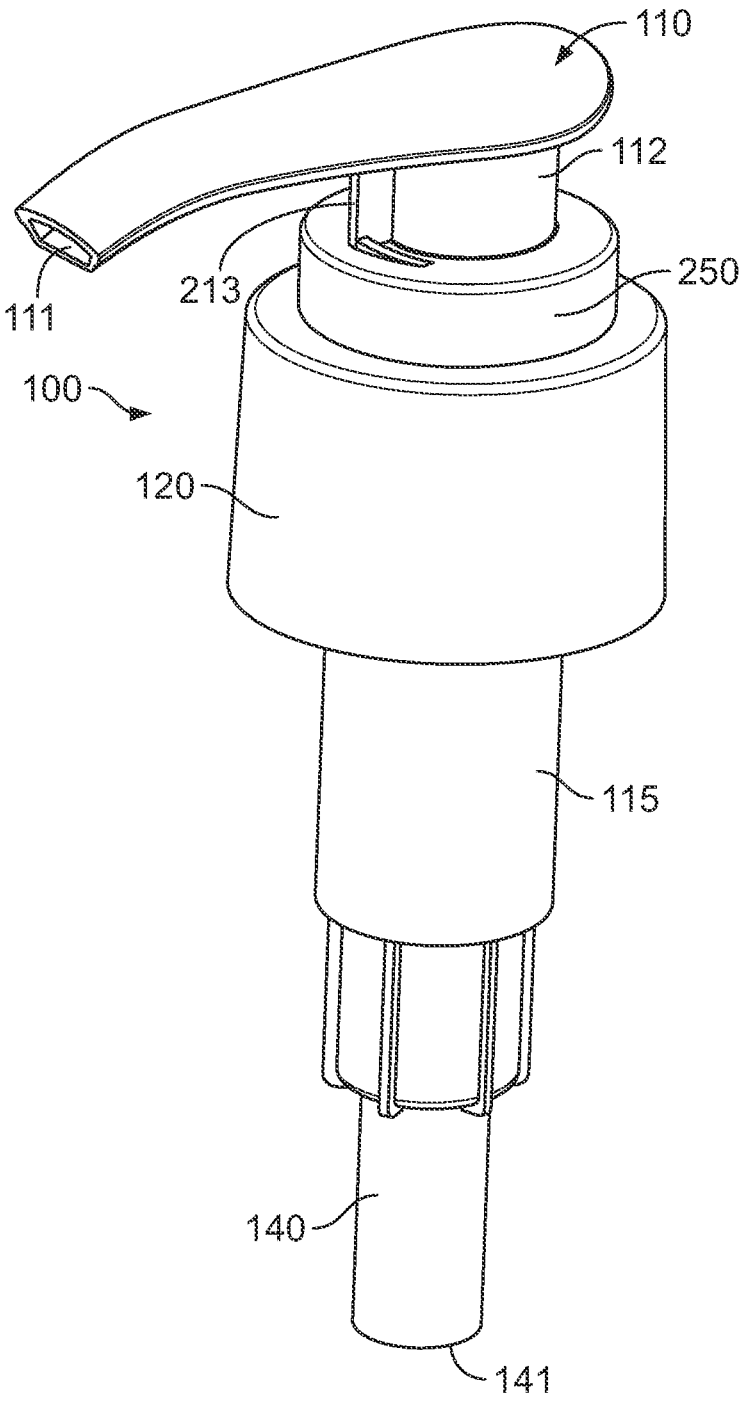
FIG. 1 is an isolated perspective view of a dispenser head and pump body.
Figure 2:
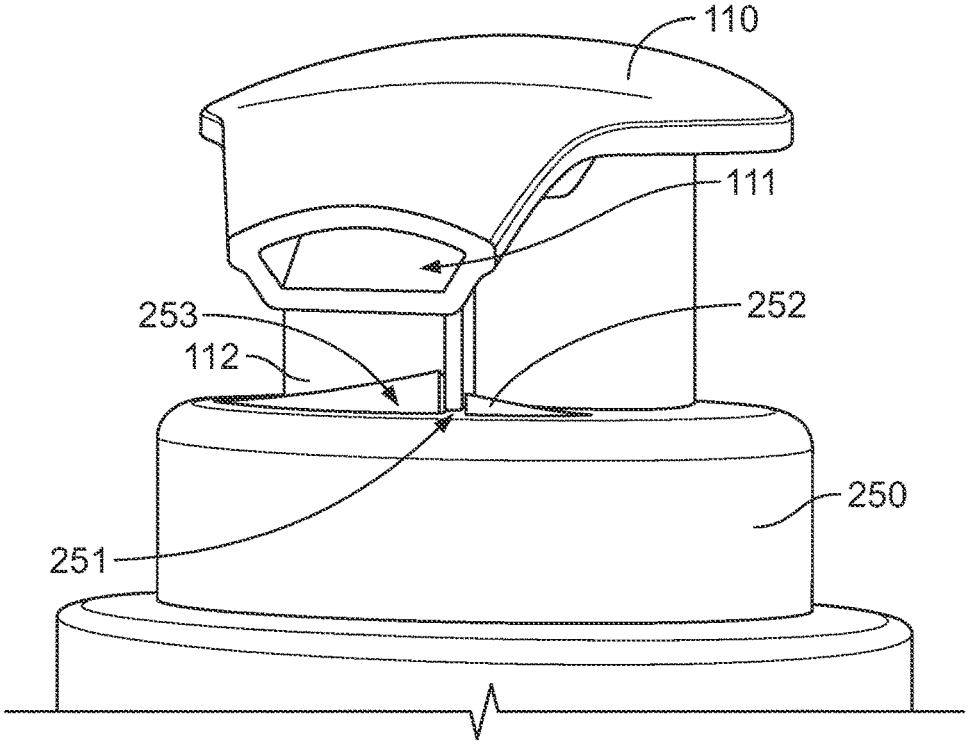
FIG. 2 is a partial perspective view of the dispenser head in its lockdown position and with the anti-rotational tab or fin in its engaged position (i.e., captured between ramped catchments on the top facing of the chaplet).
Figure 3:
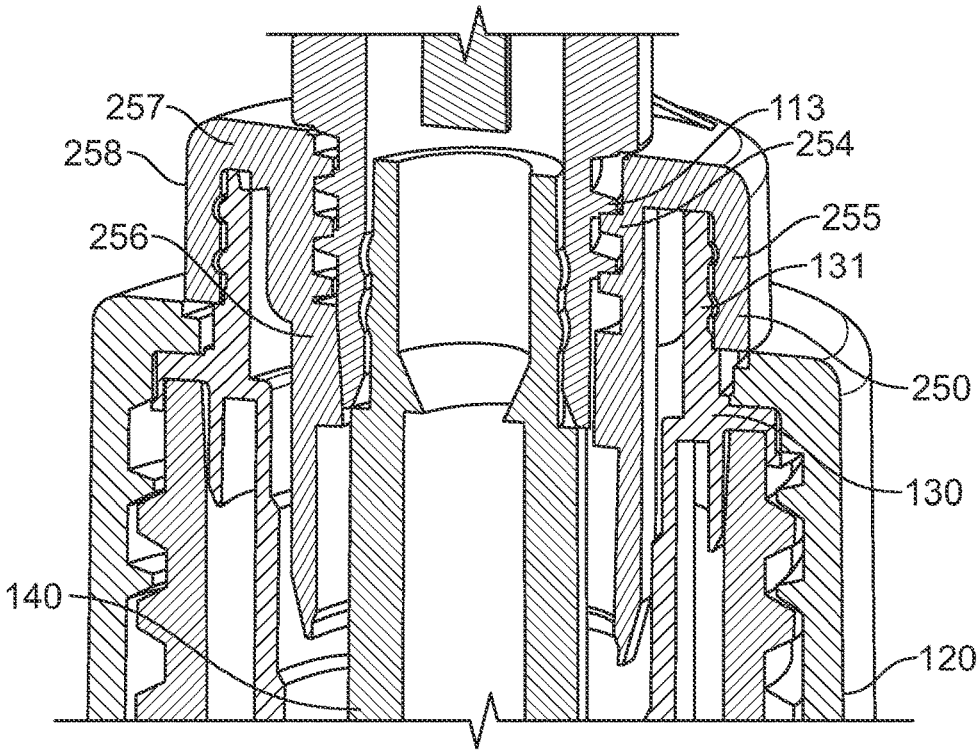
FIG. 3 is a cross sectional perspective side view of the chaplet, closure, and pump body engaging a container neck.

Specific reference is made to the appended claims, drawings, and description, all of which disclose elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

With reference to the drawings, a dispenser pump is attachable to a container neck. The dispenser head includes screw threads which engage corresponding structure on the portion of the pump that remains fixed to the container neck (e.g., by way of a separate, cooperating set of screw threads on the closure or skirt and the periphery of the container neck). When all screw threads are tightened, the dispenser head is restrained from extending which, in turn, closes and seals the container. Notably, while screw threads are shown, other forms of engaging the structures are contemplated, including any combination of snap-fittings, slotted tabs, interference fits, and the like.

While this lockdown mechanism is sufficient to keep the container sealed, the impact, vibration, and generally unpredictable movements associated with e-commerce shipping (and, particularly, e-commerce shipping in which additional packaging or protective structures are not used) can cause the mechanism to become partially or completely disengaged. For example, the head may rotate relative to the closure, which potentially results in misalignment of vents and sealing surfaces within the pump and corresponding potential for leakage and loss of fluid.

Therefore, a series of anti-rotational features are provided. Generally speaking, these features can be overcome by application of sufficient force by the user that is less than the effort required to disengage the lockdown mechanism itself. Nevertheless, these anti-rotational features must remain robust enough to prevent the aforementioned and unwanted movement and misalignment that can sometimes occur during e-commerce shipping.

Exterior locking ramps/ribs, concealed engagement teeth or castellations, and internal back off ribs jointly and severally cooperate to prevent unwanted rotation of the pump relative to the container (which could lead to leakage and/or inadvertent actuation of the pump). These features can be formed along part or all of at least one circumference of the pump body (i.e., the outer cylinder which encases the moveable piston) where it interfaces the closure attaching the pump to the container.

A chaplet and/or shroud may also be captured on the stem of the pump and fits over a portion of the closure so as to conceal the anti-rotational features. The chaplet may be fitted coaxially within a portion of the pump body to ensure a good fit, although it may be possible to provide a separate, more free-floating structure to accomplish this same purpose. The shroud includes a skirt formed integrally with or in addition to the chaplet, but serving a similar purpose.

Separately, both the lockdown and anti-rotational features must require less effort to engage/disengage in comparison to the means by which the pump itself is secured to the container. That is, to the extent the pump relies upon a screw-type closure to engage the container neck, the force to dislodge and rotate the pump relative to the container must be greater than that required for the anti-rotation and lockdown features.

In past designs, the closure-to-container attachment included an extra anti-rotational feature to increase the effort required to disengage the pump from the container. In some instances, these features would include fixed or ratchet-style engagement so as to stay coupled during engagement/disengagement of the lockdown or anti-rotational features. For example, FIG. 8 of International Publication No. WO2018/215659 and FIG. 10 of United States Patent Publication No. 2018/0034291 show interlock projections formed on the container neck. These projections formed on or in the container cooperate with corresponding structure on the closure cap of the pump to guard against the closure decoupling from the container. However, in some instances, it may not be feasible to use specially modified container necks. Further, these added features on the container neck may incur additional manufacturing cost and complexity.

In one aspect or optional feature in the current invention, along an exterior top facing, a gap defined by a large stopper ramp/rib on one side and a comparatively smaller head rotation back-off ramp/rib on an opposing side receives an anti-rotation tab or fin. The tab is attached to and moves in concert with the dispensing head is received. The stopper ramp/rib and the head rotation back-off ramp/rib are sized (both in terms of axial elevation relative to the pump's reciprocation axis and in terms of the incline of the ramp itself) to receive and capture the tab within the gap. However, the construction of the tab is resilient enough to allow it to be released from the gap when sufficient rotational force away from the stopper is deliberately exerted by the user. This arrangement provides further assurance that the dispensing head remains in a locked down position, so as to avoid leakage and unintended actuation (e.g., during e-commerce shipping).

Separately, a body or closure insert is captured beneath the closure cap. This insert includes separate pairs of ratchet teeth and/or castellations along two different circumferences. First, the ratchet teeth provide a one-way tightening grip between the body insert and corresponding engagement features formed on the closure cap so that the closure cap can rotate and tighten the pump without being released. Separately, castellations formed on the radially extending flange create frictional engagement with the container neck as the closure cap is tightened.

In addition to the circumferentially oriented features, the body insert includes axially-aligned walls. Along its lower end, an axial wall makes a plug seal with the inner facing of the container neck (i.e., the opening). The axial extending wall above the flange includes engagement features to secure the insert to the chaplet.

The frictional engagement, plug seal, and the fact that the closure cannot easily be backed off from the container (owing to the ratchet teeth) ensure a strong pump closure-to-container engagement. In turn, the aforementioned lockdown and anti-rotational features can be used without loosening the pump from the container itself. Further—and more importantly—all of these benefits are realized without relying upon a modified container/neck, as was necessitated by the prior art.

The remaining features of the pump relate to its basic function. For example, a biasing member extends the dispenser head axially away from the body. This motion causes the piston to slide within the pump body to create suction within the pump chamber. Valves at either end of the chamber ensure the pump can be primed and the fluid expelled from the chamber, as appropriate to the reciprocating motion of the dispenser head and piston. A dip tube ensures that fluid can be drawn up from the internal volume of the container.

All components should be made of materials having sufficient flexibility and structural integrity, as well as a chemically inert nature. The materials should also be selected for workability, cost, and weight. Common polymers amenable to injection molding, extrusion, or other common forming processes should have particular utility.

Turning now to the features specifically illustrated in the drawings, FIG. 1 shows an isolated view of the closure and pump assembly 100. Notably, assembly 100 can be fitted to containers in a manner that imparts lockdown functionality, but without the need to specifically modify the container neck. This is a significant improvement over past designs, such as the one disclosed in International Publication No. 2018/215659.

Pump assembly 100 shares a number of general, exterior features with past pumps. For example, dispenser head 110 includes a dispensing outlet 111. The interior of head 110 encases a dispensing channel that connects to an axial channel carried within stem 112. Closure 120 is formed as a hollow cylindrical tube to receive the stem 112 at the top end and to connect to pump engine 115 at the opposing, bottom end. A dip tube 140 or socket therefor connects to the bottom end of the pump 130, thereby creating an inlet 141 to draw fluid from a container (not shown). Generally speaking, engine 115 is partially encased by the closure 120 at its upper end, although actuator 110 and stem 112 are associated with engine 115, along with the body insert 130 (which is, itself, formed separately from or integrally with a pump chamber that includes or contains any of biasing member(s), a piston, valves, and optional vents in line with the skilled person's knowledge) and other components described below.

A number of additional features distinguish certain aspects of the invention, all of which will be described in greater detail below. For example, anti-rotation tab or fin 213 extends radially outward from the stem 112. Tab 213 is made from a resilient material that flexes to be received within an anti-rotation groove 251 formed by features on a top facing of chaplet 250. Chaplet 250, itself, couples to the pump body 130 while simultaneously being captured by a portion of the closure 120. The groove 251 is defined by a pair of circumferential ramps 252, 253 disposed on top of the chaplet 250, preferably on its outer, top surface. Stopper ramp 253 may be larger in comparison to engagement ramp 252 so as to preferentially limit rotation of the head 110. Additional and/or alternative lockdown and anti-rotational features could be incorporated, such as those disclosed in United States Patent Publications 2017/0128966; 2017/0128967; and 2018/0304291, as well as U.S. Pat. Nos. 7,802,701 and 8,827,121 and International Publications WO 2017/186541 and WO 2017/198626, all of which are incorporated by reference herein.

A chaplet 250 includes screw threads 254 along its central aperture to receive stem 112 and engage corresponding threads 113 on the stem 112. This arrangement provides lockdown functionality. Further, the anti-rotational tab 213 fitted within gap 251 ensures this lockdown will not be accidentally disengaged during shipment (or by way of incidental handling).

Along its inner facing, chaplet 250 is held to the body insert 130 by corresponding and respective engagement features 255, 131 (counter-bored screw threads, bead-and-groove, snap-fitted protrusions, etc.). This arrangement means that chaplet 250 includes an annular groove or slot 256, disposed downwardly, to coaxially receive the terminal edge of the body 130.

This arrangement imparts an inverted U-shape to any given cross sectional segment of the chaplet. Thus, chaplet 250 includes a hollow, centrally disposed cylindrical tube 256 on which the features 254 such as lockdown threads are disposed. A top panel 257 extends outward from tube 256, with an outer skirt 258 extending downward from the panel 257 proximate its outer periphery. Features 255 are formed on an inner facing of skirt 258 so as to couple the chaplet 250 to the body insert 130 and, more generally, to the pump 100. In total, chaplet 250 is configured so as to engage and conceal the body insert 130 while sitting atop and adjacent to the closure 120.

Pump body or piston carrier 140, which can be regarded as a lower part of the stem, sealingly connects to the mentioned stem 112 via engagement features, and this combination of features is received through and, when not constrained by the lockdown feature, moves axially within the tube 256. Body 140 and stem 112 are also hollow, so as to form a fluid flow path. Body 140 connects to other pump engine features as are known in the art, including a biasing member/spring to promote reciprocation and suction of fluid. Valving is also provided so as to capture and then expel fluid through the engine (i.e., body 140, stem 112, head 110, etc.).

Body insert 130 also has a hollow tubular shape. At its upper end, insert 130 includes an axial extension 132 on which formations 131 couple to the chaplet 250. Tubular chaplet section 256 (and other components received within it) are coaxially received through the central aperture inherent to the hollow shape of insert 130. At the lowermost extremities of insert 130, a separate axial wall 133 connects to or is integrally formed as part of the pump engine.

A radial flange 134 extends outward from walls 132 and/or 133. Flange 134 is configured to engage the terminal edge of the container neck 50 so as to form a fluidic seal therewith. Castellations or other frictional formations (as described below) are associated with flange 134, while anti-back off formations (also described below) are formed proximate to and preferably above flange 134.

A third axial extension, in the form of a plug seal wall 135, extends away from flange 134, preferably along its lower edge. Plug wall 135 may be angled and/or tapered so as to fit securely within the opening defined by container neck 50. Wall 135 may be offset from wall 133 so as to define an axial gap therebetween. This gap may accommodate any inward radial movement of the wall 135 as it flexes to create a plug seal with the container neck 50.

Figure 6:
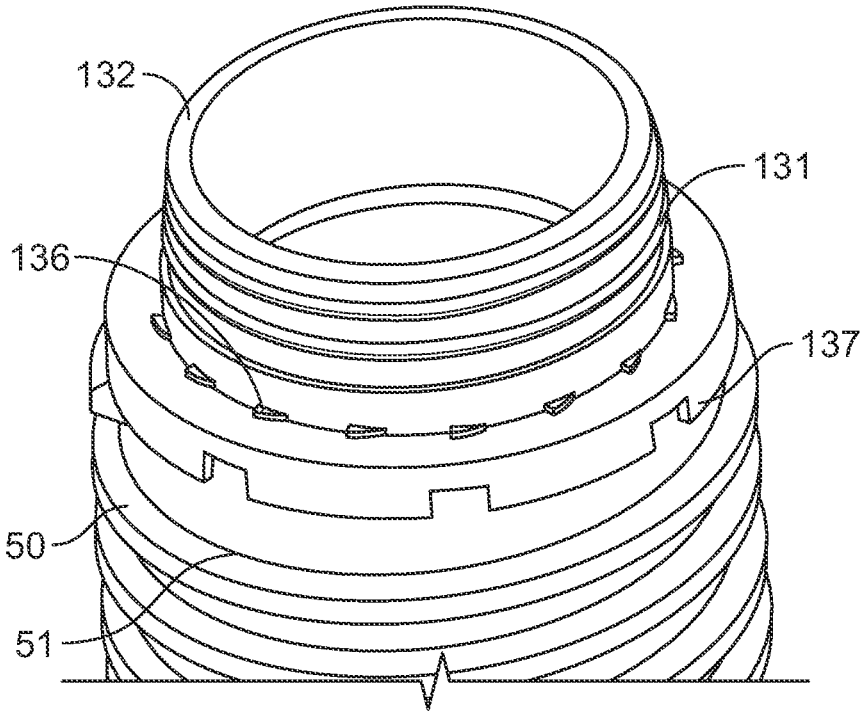
FIG. 6 is a perspective view of the pump body seated on the container neck so as to show anti-back off ribs or ratchet teeth on the body/closure plug engaging corresponding structures on the closure, but with the closure and chaplet omitted.
Figure 7A:
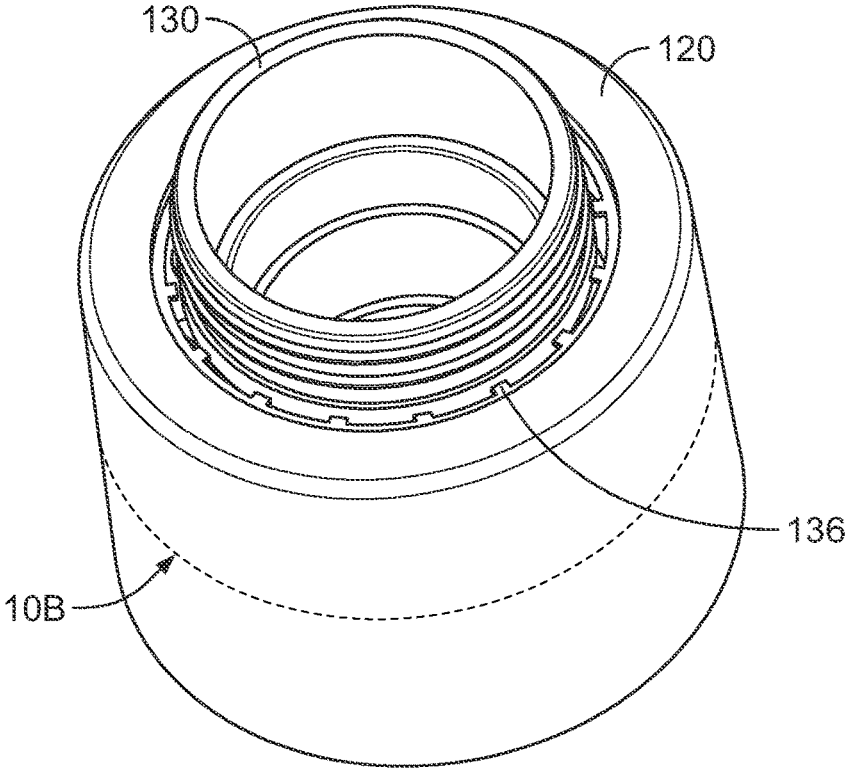
Figure 7B:
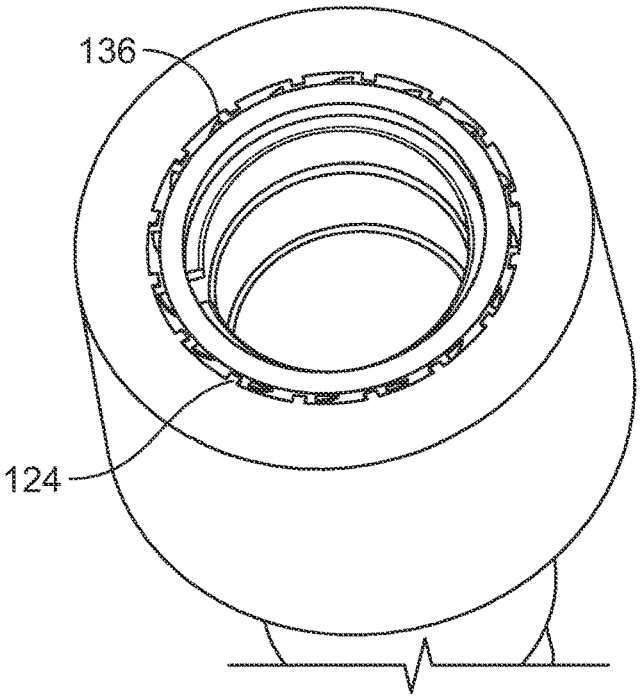
FIG. 7B represents a cross sectional view taken along a horizontal plane defined by 10B, both showing the anti-back off ribs/ramps illustrated in FIG. 5.

Proximate to or above the flange 134, a plurality of spaced apart teeth 136—see FIGS. 6, 7—are oriented or distributed circumferentially on an outer facing side of wall 132. Specifically, teeth 136 are positioned between the planar top surface of the flange and beneath the chaplet-engagement feature 131. As described below, teeth 136 cooperate with corresponding features on the closure 120 to ensure the closure 120 may only be rotated in one direction. Also, while the term teeth is used, it will be understood that any ramped or cammed feature that allows rotational movement in one direction (but not the other) may be employed—hereafter referred to as an anti-rotational projection. In one aspect, a plurality of flexibly resilient, evenly spaced, and axially aligned two-sided projections. One side is ramped or gently curved so as to allow the corresponding feature on the inner circumference of the closure 120 to slide over the ramp during rotation of the elements, while the second side is relatively flattened (e.g., aligned along a straight radius of the circular-shaped insert 130) so as to act as a catch relative to the closure feature, thereby preventing rotation.

Figure 4A:
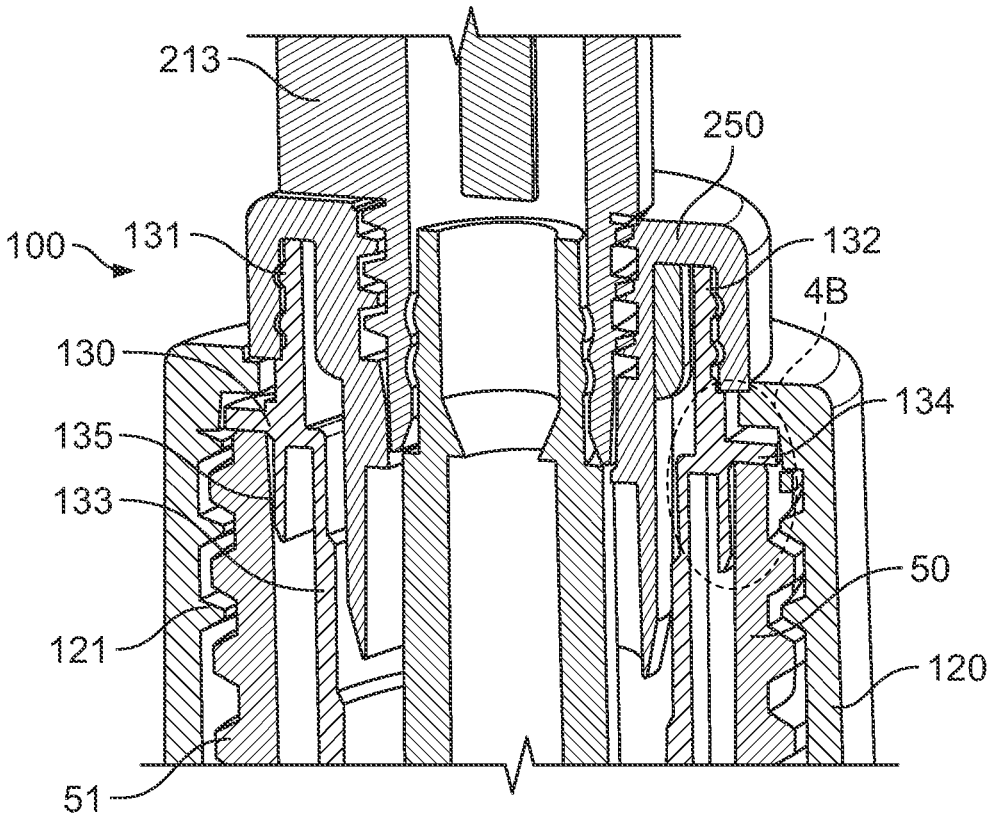
FIGS. 4A and 4B are similar to the view in FIG. 3, showing grips or castellation teeth on the pump body disengaged so as to leave a gap between the chaplet and the closure prior to tightening, with FIG. 4B providing an enlarged view at callout 4A shown in FIG. 4A.
Figure 4B:
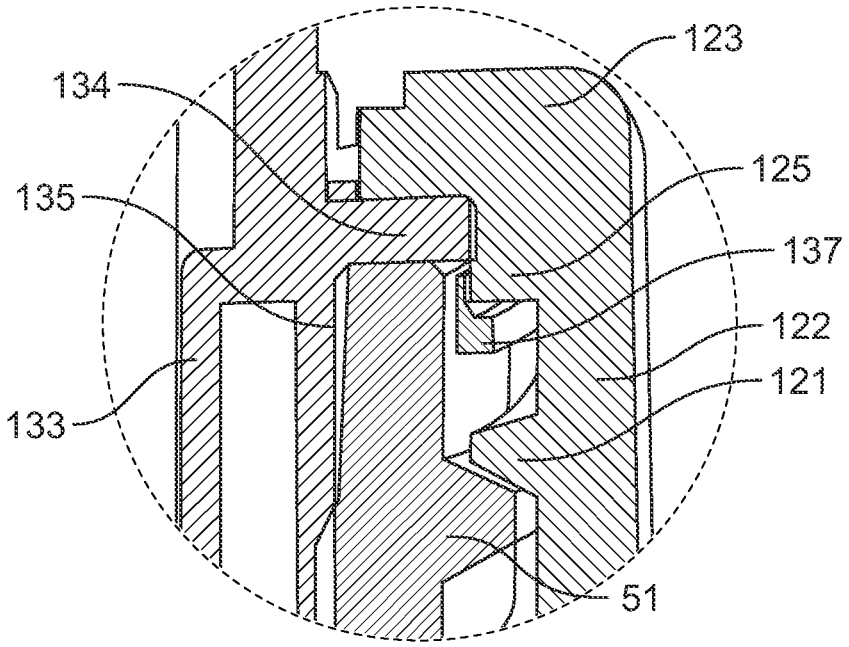
Figure 5:
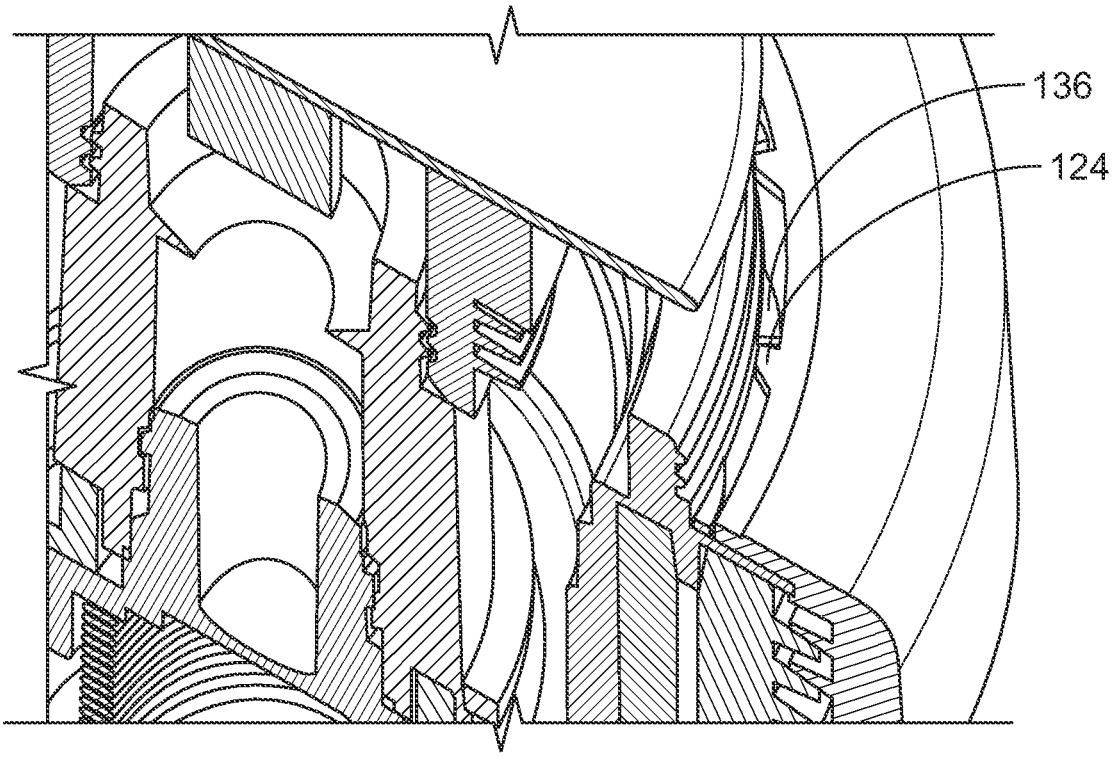
FIG. 5 is a cross sectional side view similar to (but at a slightly different angle than) the view in FIG. 3, specifically highlighting the presence and positioning of anti-back off ribs/ramps on corresponding peripheral sections of the pump body and closure.

Additionally, at the outermost circumferential edge of the flange 134, at least one frictional projection 137 is provided. Preferably, a plurality of projections 137 are provided, extending axially away from the flange 134 (above and/or below). See FIGS. 4B and 6. Projections 137 can be regularly and repeatably shaped, such as square or triangular, with the axial extension running parallel to the wall 135 and/or the inner facing of the closure skirt 122. However, the axial length of projections 137 should be sized so as not interfere with the engagement threads 51,121. In appearance, the projections 137 appear as castellations along the outer periphery of the flange 134.

In operation, as the closure 120 is rotated relative to the neck, threads 51,121 as respective container-attachment features urge the top panel 123 of the closure against the flange 134. In turn, flange 134 seals the top terminal edge of the container neck 50. Further, the projections 137 will be urged into intimate contact with the outer circumferential edge of the neck 50. Owing to their spaced apart nature, projections 137 will thus serve to create and enhance the seal (and, at least with respect to the projections 137, frictional fit) between the insert 130 and the container 50 along three separate planes—the interface between plug seal wall 135 and the inner portions of neck 50, along the top edge (as noted above), and along the interface of the projections 137/skirt 122 and the outer facing of neck 50. To the extent that the wall 135 is tapered, the downward axial force created as the closure 120 is tightened serves to further wedge the wall 135 into a sealing arrangement.

Further, owing to the teeth 136 and, separately, the frictional fit induced by the projections 137, the closure 120 cannot be backed off of this sealing fit relying on ordinary force (i.e., it is possible to rely upon a tool and/or to use sufficient force to disengage/break the projections 137). In turn, this tight and immovable seal eliminates the need to have specialized features formed on the container neck 50 itself. Thus, pump 100 can be affixed to conventional container necks having standardized opening sizes and wall thicknesses.

Figure 8A:
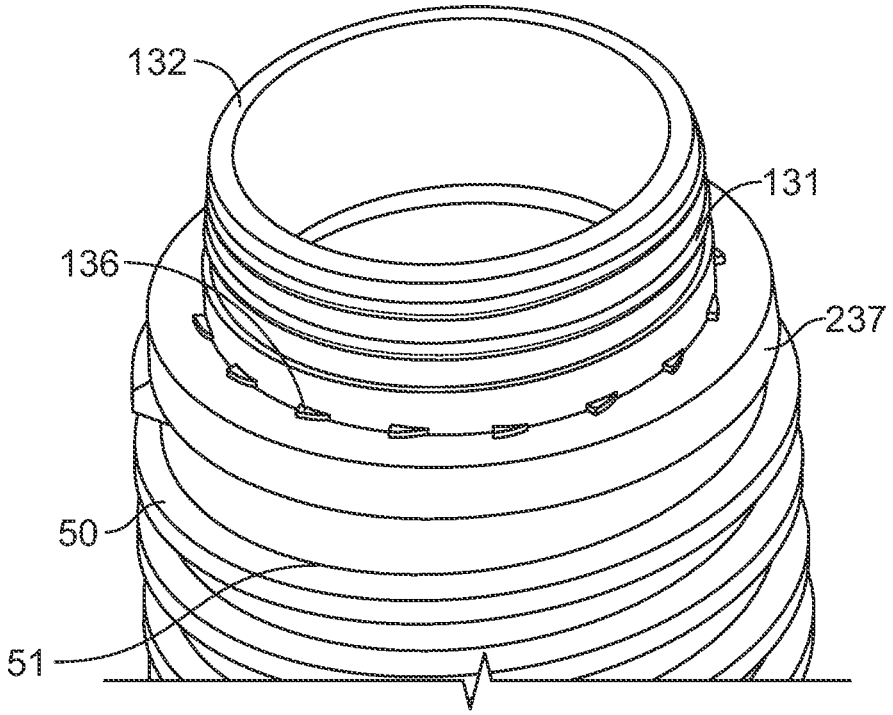
FIG. 8A is a perspective view of an alternative pump body seated on the container neck, with the closure and chaplet omitted, so as to highlight a plug seal-type continuous ring serving as the frictional projection.
Figure 8B:
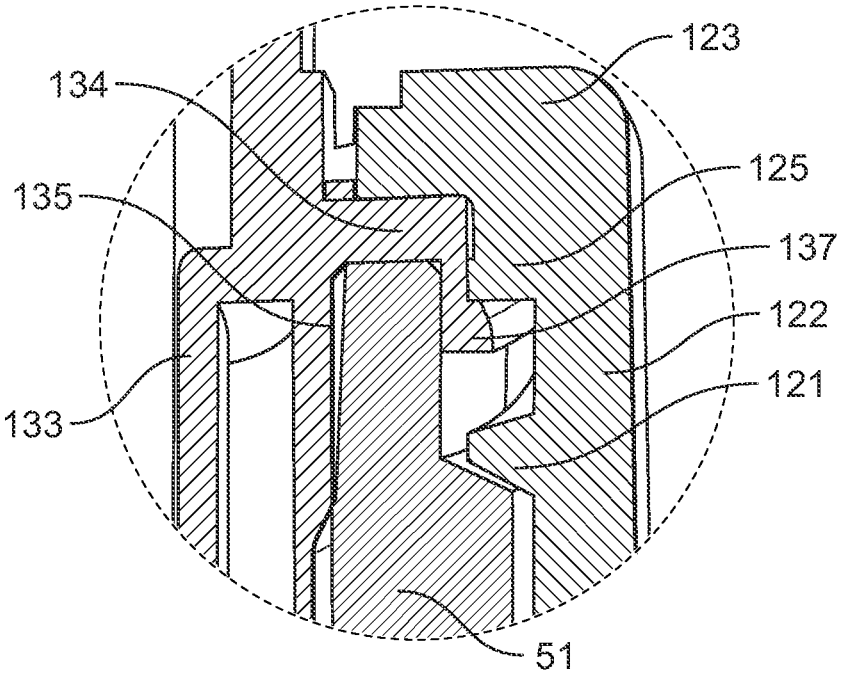
FIG. 8B illustrates a sectional view, similar to that shown in FIG. 4B, but with the plug seal-style continuous ring provided as the frictional projection.

As seen in FIGS. 8A and 8B, an alternative arrangement is possible in which the projections 137 are replaced by a continuous, preferably tapered flange 237. Instead of regular, repeatably spaced spaced members, flange 237 is essentially a continuous axial wall, approximately parallel to plug seal wall 135, extending downward from the edge of radial flange 134. In some aspects, the thickness of the flange 237 varies so as to increase radial/inward compression as the skirt 122 of closure 120 is urged downward. As shown in FIG. 8B, the flange 237 is slightly thicker at its terminal edge (in comparison to where it joins the flange 134). Nevertheless, flange 237 may also have an essentially consistent thickness along its axial length or, by virtue of a cooperating shape imparted to the radial facing of annular seat 125, flange 237 may even taper inward. As above, the continuous ring or flange 237 serves to establish sufficiently tight engagement between the body 130 and the container neck 50, with the cooperating threads 51,121 serving to enhance the force necessary to sufficiently engage and seal these components. Desirably the one or more frictional projections is/are formed and positioned so as to be progressively compressed, preferably between a radially-inward surface of the closure and a radially-outward face of the container neck edge, as the closure moves to the fully engaged position on the container neck with the flange trapped against an upward edge face of the container neck.

Standardized opening sizes and wall thicknesses depend, in part, on materials and intended use for the container itself. Thermoplastic or thermosetting resin mixtures are preferred owing to their ubiquitous nature, as well as their relatively fungible nature with respect to closures. These materials may be extrusion blow-molded, injection blow-molded, or formed according to any number of other common methods which influence the wall thickness, neck opening, and materials selection. As a non-limiting example representative of the knowledge of those skilled in this field, polyethylene terephthalate containers used for beverages typically have a thickness of 0.01 to 0.02 inches (i.e., 250 to 500 micrometers), with an opening diameter of about 1.1 inches (i.e., 28 mm).

As noted above, closure 120 consists of a skirt 122 extending from an annular shaped top panel 123. Cooperating projections 124 are formed along the circumference where closure 120 interfaces with the body insert 130 and, more specifically, the projections 136 and 137. A chaplet 250, decorative collar, or other skirt/shroud-like extension from the plunger or pump body can be provided above and proximate to the closure to conceal the interface and prevent ingress of unwanted fluids into the interstices of the pump 100.

Cooperating projections 124 may be in the form of prismatic tabs, teeth, or embedded grooves. These projections 124 are spaced apart so as to engage at least a portion of the corresponding projections 136 on the body insert 130. In one aspect, the projections 124 can be provided along an inner radial facing of the top panel 123.

As previously noted, threads or other container neck engagement features 121 are situated along the inner facing of skirt 122. At the junction where the skirt 122 joins the top panel 123, a reinforced annular seat 125 may be formed so as to engage the periphery of flange 134 and/or projections 137. When used, seat 125 urges the intimate contact (or even embeds) the projections 137 into the neck 50.

The body insert 130 and closure 120 combination could be employed on any style of pump or similar closure, including squeeze-activated pumps, reciprocating pumps, and the like. In some aspects, the chaplet 250 and pump stem 112, including anti-rotation fin 213, enhance the functionality of the pump 100 and enable e-commerce shipping (owing to the combined protections of the lock down mechanism, anti-rotation protections, and excellent seal formed by the body insert and closure).

For the sake of clarity, the anti-rotational fin 213 is designed to prevent the relative movement between the stem 112 and the closure 120. Separately and more importantly, the anti-rotational projections 136 and corresponding or cooperating projections/tabs 124 prevent rotation of the closure 120 and the container 50 in a single direction (i.e., the closure 120 may be screw-tightened onto the container 50, but it cannot be easily reversed). Thus, while these features are both anti-rotational in function, each serves a distinct purpose with projections 124, 136 enabling a secure enough fit to ensure the lockdown feature (i.e., 113, 254) can be engaged and disengaged without disrupting the seal between the closure 120 and the container 50. In this context, the added anti-rotational protection provided by fin 213 and ramps 252, 253 is merely a further safeguard against unwanted extension/deploying of the actuator head 110 away from the pump engine 115 and the container 50 to which it is affixed.

Notably, this application contemplates improvements to the design described in International Patent Publication WO 2018/215659, published on Nov. 29, 2018 and entitled "Dispenser Pumps and Dispensers" (also pending before the United States Patent and Trademark Office as a national stage application Ser. No. 16/615,907, filed on Nov. 22, 2019 and claiming priority to this International Patent Application). Certain aspects of this invention are well-suited for use in combination with the aspects disclosed in these co-pending applications, which are therefore incorporated by reference herein.

In view of the foregoing, various aspects of the invention may include any combination of the following features:

- a body insert having an tubular member aligned along an axis, a annular flange extending radially outward from an outer facing of the tubular member, a plug seal wall extending downward from the annular flange, one or more frictional projections formed on or proximate to a peripheral edge of the annular flange, and one or more anti-rotational projections formed along a circumference on the outer facing of the tubular member;
- a closure having an annular top panel that sealingly engages a portion of the top facing of the annular flange, a skirt extending down from the annular top panel, and corresponding anti-rotational projections formed along a circumference on an inner facing of the closure and wherein the skirt: (i) sealingly engages a peripheral edge of the annular flange, and (ii) container-attachment features such as a thread positioned along an inner facing of the skirt;
- a pump engine coaxially positioned within the tubular member;
- the plug seal wall is tapered relative to the axis so as to sealingly engage a annular opening in which the plug seal wall is coaxially received;
- a chaplet attached to a terminal end of the tubular member;
- at least one of the anti-rotational projections and the corresponding anti-rotational projections are formed as ratchet teeth spaced apart along a common circumferential plane;
- the corresponding anti-rotational projections have a prismatic shape extending to a top surface of the annular top panel;
- the one or more frictional projections is formed as a single, continuous axially-extending wall;
- the single, continuous axially-extending wall is substantially parallel to the plug seal wall;
- the single continuous axially-extending wall is tapered so as to have a different thickness at a terminal edge in comparison to a thickness where the single continuous axially extending wall is connected to the annular flange;
- the single continuous axially-extending wall is urged radially inward by the inner facing of the skirt of the closure when the closure is rotatably secured to a container;

the chaplet conceals a gap accommodating an interface between the anti-rotational projections and the corresponding anti-rotational projections;

the chaplet is positioned above and proximate to the closure and the body insert;

the chaplet includes a central tube received coaxially within the tubular member and an outer skirt attached to the central tube by a annular chaplet panel;

a pair of ramps having different heights relative to the axis are spaced apart to receive an anti-rotational tab formed on a reciprocating stem of the pump engine;

a portion of the tubular member is received within a gap bounded by the outer skirt, the annular chaplet panel, and the central tube, with the tubular member attached to an inner facing of the outer skirt;

pump lockdown features such as threads are disposed on an inner facing of the central tube;

the pump engine reciprocates along the axis;

the annular flange is positioned at a midsection of the tubular member or body insert;

a chaplet engagement wall is integrally formed with the tubular member on an opposite facing, relative to the plug seal wall, of the annular flange;

the corresponding anti-rotational projections are formed on a radial, or radially-directed circumferential, edge of the annular top panel;

the frictional projections extend downward and partially below the annular flange;

the plug seal wall is positioned coaxially within and spaced apart from the frictional projections;

the plug seal wall is spaced apart from the frictional projections at a distance corresponding to a conventional, standardized container size thickness;

the closure includes an annular seat disposed at a junction of the annular top panel and the skirt, said annular seat engaging and urging the frictional projections radially inward toward the plug seal wall; and rotational engagement of the container-attachment features urges the frictional projections into a compressive engagement with the closure and a container neck;

disengagement of the rotational engagement of the container-attachment features is prevented by cooperation of the anti-rotational projections with the corresponding anti-rotational projections.

All components should be made of materials having sufficient flexibility and structural integrity, as well as a chemically inert nature. The materials should also be selected for workability, cost, and weight. In addition to the materials specifically noted above, common polymers amenable to injection molding, extrusion, or other common forming processes should have particular utility, although metals, alloys, and other composites may be used in place of or in addition to more conventional container and closure materials.

References to coupling in this disclosure are to be understood as encompassing any of the conventional means used in this field. This may take the form of snap—or force fitting of components, although threaded connections, bead-and-groove, and slot-and-flange assemblies could be employed. Adhesive and fasteners could also be used, although such components must be judiciously selected so as to retain the underlying design goals inherent to the assembly.

In the same manner, engagement may involve coupling or an abutting relationship. These terms, as well as any implicit or explicit reference to coupling, will should be considered in the context in which it is used, and any perceived ambiguity will be resolved by referring to the drawings.

Although the present embodiments have been illustrated in the accompanying drawings and described in the foregoing detailed description, it is to be understood that the invention is not to be limited to just the embodiments disclosed, and numerous rearrangements, modifications and substitutions are also contemplated. The exemplary embodiment has been described with reference to the preferred embodiments, but further modifications and alterations encompass the preceding detailed description. These modifications and alterations also fall within the scope of the appended claims or the equivalents thereof.

The invention claimed is:

1. A closure for a dispenser, the closure comprising:

a body insert having a tubular member aligned along an axis, an annular flange extending radially outward from an outer facing of the tubular member, a plug seal wall extending downward from the annular flange, one or more frictional projections formed around a peripheral edge of the annular flange, and one or more anti-rotational projections formed along a circumference on the outer facing of the tubular member and wherein the one or more frictional projections are configured to sealingly engage a container neck;

a closure having an annular top panel that sealingly engages a portion of the top facing of the annular flange, a skirt extending down from the annular top panel, and corresponding anti-rotational projections formed along a circumference on an inner facing of the closure and wherein: (i) the skirt sealingly engages a peripheral edge of the annular flange, (ii) container-attachment features are positioned along an inner facing of the skirt, and (iii) wherein corresponding anti-rotational projections of the closure cooperate with the one or more anti-rotational projections of the body insert to restrict rotation of the closure in a predetermined direction; and a pump engine coaxially positioned within the tubular member.

2. The closure according to claim 1 further comprising a chaplet attached to a terminal end of the tubular member and positioned above and proximate to the closure and the body insert.

3. The closure according to claim 2 wherein the chaplet includes a central tube received coaxially within the tubular member and an outer skirt attached to the central tube by a annular chaplet panel.

4. The closure according to claim 3 wherein a portion of the tubular member is received within a gap bounded by the outer skirt, the annular chaplet panel and the central tube of the chaplet, with the tubular member attached to an inner facing of the outer skirt.

5. The closure according to claim 3 wherein the pump engine reciprocates along the axis and wherein pump lockdown features are disposed on an inner facing of the central tube of the chaplet.

6. The closure according to claim 5 wherein the annular flange is positioned at a midsection of the tubular member.

7. The closure according to claim 1 wherein the annular flange is positioned at a midsection of the tubular member.

8. The closure according to claim 2 wherein a chaplet engagement wall is integrally formed with the tubular member on an opposite facing, relative to the plug seal wall, of the annular flange.

9. The closure according to claim 1 wherein the corresponding anti-rotational projections are formed on a radial edge of the annular top panel of the closure.

10. The closure according to claim 9 wherein the one or more frictional projections extend downward and partially below the annular flange.

11. The closure according to claim 10 wherein the one or more frictional projections is a single, continuous flange.

12. The closure according to claim 10 wherein the plug seal wall is positioned coaxially within and spaced apart from the one or more frictional projections.

13. The closure according to claim 12 wherein disengagement of the rotational engagement of the container-attachment features of the closure is prevented by cooperation of the anti-rotational projections with the corresponding anti-rotational projections.

14. The closure according to claim 1 wherein the plug seal wall is positioned coaxially within and spaced apart from the one or more frictional projections.

15. The closure according to claim 1 wherein the plug seal wall is tapered relative to the axis so as to sealingly engage a annular opening in which the plug seal wall is coaxially received.

16. The closure according to claim 1 wherein the closure includes an annular seat disposed at a junction of the annular top panel and the skirt, to engage and urge the one or more frictional projections radially inward toward the plug seal wall.

17. The closure according to claim 16 wherein the one or more frictional projections is a single, continuous flange.

18. The closure according to claim 1 wherein rotational engagement of the container-attachment features of the closure urges the one or more frictional projections into a compressive engagement with the closure and a container neck.

19. The closure according to claim 18 wherein the one or more frictional projections is a single, continuous, tapered flange.

20. The closure according to claim 1 wherein disengagement of the rotational engagement of the container-attachment features of the closure is prevented by cooperation of the anti-rotational projections with the corresponding anti-rotational projections.

* * * * *